US008512488B2

(12) United States Patent
Imano et al.

(10) Patent No.: US 8,512,488 B2
(45) Date of Patent: Aug. 20, 2013

(54) NI—FE BASED FORGING SUPERALLOY EXCELLENT IN HIGH-TEMPERATURE STRENGTH AND HIGH-TEMPERATURE DUCTILITY, METHOD OF MANUFACTURING THE SAME, AND STEAM TURBINE ROTOR

(75) Inventors: Shinya Imano, Hitachi (JP); Hirotsugu Kawanaka, Hitachi (JP); Hiroyuki Doi, Tokai (JP); Tatsuya Takahashi, Muroran (JP); Tsukasa Azuma, Muroran (JP); Koji Kajikawa, Muroran (JP)

(73) Assignees: Hitachi, Ltd., Tokyo (JP); The Japan Steel Works, Ltd., Tokyo (JP)

( * ) Notice: Subject to any disclaimer, the term of this patent is extended or adjusted under 35 U.S.C. 154(b) by 1141 days.

(21) Appl. No.: 11/836,900

(22) Filed: Aug. 10, 2007

(65) Prior Publication Data

US 2008/0213099 A1 Sep. 4, 2008

(30) Foreign Application Priority Data

Aug. 25, 2006 (JP) ..... 2006-229324

(51) Int. Cl.
*C22F 1/10* (2006.01)
*C22C 19/05* (2006.01)
*F01D 5/14* (2006.01)

(52) U.S. Cl.
USPC ..... 148/677; 420/447; 416/241 R

(58) Field of Classification Search
USPC ..... 420/447; 148/677; 416/241 R
See application file for complete search history.

(56) References Cited

U.S. PATENT DOCUMENTS 2,327,839 A * 8/1943 Zschokke ..... 416/215
3,705,827 A * 12/1972 Muzyka et al. ..... 148/607
3,785,809 A * 1/1974 Cox ..... 420/448
7,168,916 B2 * 1/2007 Scarlin ..... 415/199.5

(Continued)

FOREIGN PATENT DOCUMENTS

EP 1486578 12/2004
EP 1650319 4/2006

(Continued)

OTHER PUBLICATIONS

ASM International, Materials Park, Ohio, ASM Specialty Handbook: Nickel, Cobalt, and Their Alloys: "Metallography, Microstructures, and Phase Diagrams of Nickel and Nickel Alloys", Dec. 2000, vol. 2, pp. 302-304.*

(Continued)

*Primary Examiner* — Jessee R. Roe
(74) *Attorney, Agent, or Firm* — Mattingly & Malur, PC

(57) ABSTRACT

An Ni—Fe based superalloy forging material including 30 to 40 wt % of Fe, 14 to 16 wt % of Cr, 1.2 to 1.7 wt % of Ti, 1.1 to 1.5 wt % of Al, 1.9 to 2.2 wt % of Nb, 0.05 wt % or less of C and the remainder of Ni and inevitable impurities is solution-treated and aged, and thereby γ' phase ($Ni_3Al$) having an initial mean particle size of about 50 to about 100 nm is precipitated. This superalloy is excellent in high-temperature strength and high-temperature ductility and can produce a large forged product of 10 ton or more. Therefore, this material is suitable for use as the material of a steam turbine rotor having a main steam temperature of 650° C. or more.

6 Claims, 7 Drawing Sheets

(56) References Cited

U.S. PATENT DOCUMENTS

| | | | |
|---|---|---|---|
| 2003/0034098 | A1 | 2/2003 | Henry et al. |
| 2004/0253102 | A1 | 12/2004 | Imano et al. |
| 2006/0088411 | A1 | 4/2006 | Imano et al. |

FOREIGN PATENT DOCUMENTS

| | | |
|---|---|---|
| JP | 60-033329 | 2/1985 |
| JP | 60-063338 | 4/1985 |
| JP | 10-226837 | 8/1998 |
| JP | 2005-002929 | 1/2005 |
| JP | 2006-118016 | 5/2006 |
| JP | 2006-124776 | 5/2006 |

OTHER PUBLICATIONS

Imano, Shinya et al, "Modification of Alloy 706 for High Temperature Steam Turbine Rotor Application", Superalloy 718, 625, 706 and Various Derivatives TMS, 2005, pp. 77-86.
European Search Report, EP 07015815, Nov. 22, 2007, 5 pp.

* cited by examiner

| | T1 ℃ | t1 h | T2 ℃ | t2 h | T3 ℃ | t3 h |
|---|---|---|---|---|---|---|
| HEAT TREATMENT A | 965~995 | 2 | 710~740 | 8 | 630 | 8 |
| HEAT TREATMENT B | 965~995 | 2 | 710~740 | 16 | 630 | 8 |
| HEAT TREATMENT C | 965~995 | 2 | 825~855 | 8 | 710~740 | 24 |

MEASUREMENT RESULTS OF INITIAL MEAN PARTICLE GRAIN SIZE OF γ' PHASE (nm)

| | ALLOY | | | | | INVENTIVE MATERIAL | | |
|---|---|---|---|---|---|---|---|---|
| | A | C | D | H | I | A | B | C | D |
| AVERAGE GRAIN SIZE OF γ' PHASE (nm) | 20 | 20 | 20 | 20 | 30 | 65 | 80 | 90 | 95 |

SCHEMATIC DIAGRAM OF AGING MATERIAL TEXTURE

NI—FE BASED FORGING SUPERALLOY EXCELLENT IN HIGH-TEMPERATURE STRENGTH AND HIGH-TEMPERATURE DUCTILITY, METHOD OF MANUFACTURING THE SAME, AND STEAM TURBINE ROTOR

BACKGROUND OF THE INVENTION

1. Field of the Invention

The present invention relates to an Ni—Fe based forging superalloy which is excellent in high-temperature strength and high-temperature ductility and a method of manufacturing the same, and also to a steam turbine rotor formed of the Ni—Fe based superalloy forging material.

2. Description of the Related Art

In order to improve power generation efficiency of a steam turbine power plant, an elevating of the main steam temperature is effective. At present, steam turbine generator plants of the 600° C. class, in which main steam temperature exceeds 600° C., are commercially employed and for the aim of further improvements to the power generation efficiency, development of the steam turbines having a main steam temperature of the 650° C. class and a main steam temperature of the 700° C. class is proceeding.

Iron and steel materials formerly used as the rotor materials are not applicable to the steam turbine of the 700° C. class, in which the main steam temperature is 700° C. or more, since such iron and steel materials have a durable temperature of about 650° C. Accordingly, it is necessary to use an Ni based superalloy having a higher durable temperature than that of the iron and steel materials, as the rotor material. Such an Ni based superalloy has higher strength than that of iron and steel materials. However, the Ni based superalloy is expensive and also is hard to produce as large forged products.

Ni based superalloys relatively facilitating the manufacturing of large forged products include A286 type, IN706 type and IN718 type Ni—Fe based superalloys. These Ni—Fe based superalloys are employed in gas turbine disks, generator rotors, etc.

The A286 type alloy is advantageous in terms of cost, since it has much Fe. However, the A286 type alloy is not suitable for the material of the steam turbine rotor having a main steam temperature of 700° C. or more, since it has weak strength. Further, the IN706 type alloy has better strength. However, the IN706 type alloy is difficult to manufacture as forged products having a weight of more than 10 tons, since the IN706 type alloy has much more content of Nb being a segregation element. Furthermore, the IN718 type alloy has better high-temperature strength than that of the IN706 type alloy. However, the IN718 type alloy has much more content of segregation elements such as Nb and Mo, and thus causes segregation easier compared with the IN706 type alloy. Therefore, it is also difficult to manufacture a steam turbine rotor having a weight of more than 10 tons based on the IN718 type alloy. Also, as used herein, the "weight of the rotor" means the weight of a finished product of a single rotor.

JP-A-2005-2929 (Abstract) discloses that a steam turbine rotor is manufactured by using Ni—Fe based superalloy forging materials that are successfully obtained by decreasing the amount of Nb compared with IN706 type alloy or IN718 type alloy and further adding Al to it to stabilize a γ' phase and to suppress the precipitation of harmful phases (i.e., η, δ, α phases) incurring embrittlement. Further, it discloses that a steam turbine rotor of a 10 ton class can be manufactured.

Furthermore, in Superalloy 718, 625, 706 And Various Derivatives TMS, 2005, p. 77 (non-patent document 1), mechanical properties of an Ni—Fe based superalloy which was subject to solution treatment and aging treatment are shown.

SUMMARY OF THE INVENTION

The invention aims at manufacturing an ultrahigh-pressure turbine rotor in steam turbine power plants of the 700° C. class having a main steam temperature of 700° C. or more, by improving an Ni—Fe based superalloy such as of the IN706 type and IN718 type.

The IN706 type or IN718 type Ni—Fe based superalloy, as described above, is employed as a gas turbine disk material. However, the IN706 type or IN718 type Ni—Fe based superalloy is difficult to produce as forged products of 10 tons or more, since solidification defects (i.e., freckle defect) are generated due to segregation of Nb.

Decreasing an amount of the segregation element Nb is effective in improving the productivity of a large steel ingot. However, precipitation in the IN706 type or IN718 type Ni—Fe based superalloy is strengthened by $Ni_3Nb$ (γ" phase), and thus if the amount of Nb is decreased, strength would be largely diminished. While it proves that such alloys exhibit good mechanical properties at 500° C. to 650° C., such alloys are hardly used at about 700° C.

It can be seen that when the IN706 type or IN718 type Ni—Fe based superalloy is exposed at 700° C. for a long time, harmful phases (i.e., η, δ, α phases) are precipitated so that it is then embrittled.

Further, it can be seen that while the rotor material disclosed in JP-A-2005-2929 (Abstract) has high strength at 700° C., it is hardly applicable to a rotor including notches because of its low tensile ductility.

Therefore, it is an object of the present invention to provide an Ni—Fe based forging superalloy which is excellent in high-temperature strength and high-temperature ductility and which can be manufactured as a large forged product of 10 tons or more, a method of manufacturing the same, and a steam turbine rotor formed of an Ni—Fe based superalloy forging material.

According to an aspect of the invention, there is provided an Ni—Fe based forging superalloy which is excellent in high-temperature strength and high-temperature ductility, the superalloy including 30 to 40 wt % of Fe, 14 to 16 wt % of Cr, 1.2 to 1.7 wt % of Ti, 1.1 to 1.5 wt % of Al, 1.9 to 2.7 wt % of Nb, 0.05 wt % or less of C, and the remainder of Ni and inevitable impurities, wherein a γ' phase ($Ni_3Al$) having an initial mean particle size of 50 to 100 nm is precipitated.

According to an aspect of the invention, there is provided a steam turbine rotor formed of an Ni—Fe based superalloy forging material including 30 to 40 wt % of Fe, 14 to 16 wt % of Cr, 1.2 to 1.7 wt % of Ti, 1.1 to 1.5 wt % of Al, 1.9 to 2.7 wt % of Nb, 0.05 wt % or less of C, and the remainder of Ni and inevitable impurities, wherein a γ' phase ($Ni_3Al$) having an initial mean particle size of 50 to 100 nm is precipitated.

According to an aspect of the invention, there is provided a method of manufacturing an Ni—Fe based forging superalloy which is excellent in high-temperature strength and high-temperature ductility, including: solution-treating an Ni—Fe based superalloy forging material including 30 to 40 wt % of Fe, 14 to 16 wt % of Cr, 1.2 to 1.7 wt % of Ti, 1.1 to 1.5 wt % of Al, 1.9 to 2.7 wt % of Nb, 0.05 wt % or less of C and the remainder of Ni and inevitable impurities; aging twice the resultant forging material at a temperature range of 825 to 855° C. and a temperature range of 710 to 740° C., respectively; and precipitating a γ' phase ($Ni_3Al$) having an initial mean particle size of 50 to 100 nm.

According to the invention, an Ni—Fe based forging superalloy having high strength and high ductility at about 700° C. and which can be manufactured as a large forged product 10 tons or greater in weight may be obtained. Such an Ni—Fe based forging superalloy allows application to steam turbine power plants of the 650° C. class or the 700° C. class in which the main steam temperature is 650° C. or more, and to integrally manufacturing large-sized steam turbine rotors of more than 10 tons as forging products.

DESCRIPTION OF REFERENCE NUMERALS AND SIGNS

Figure 1:
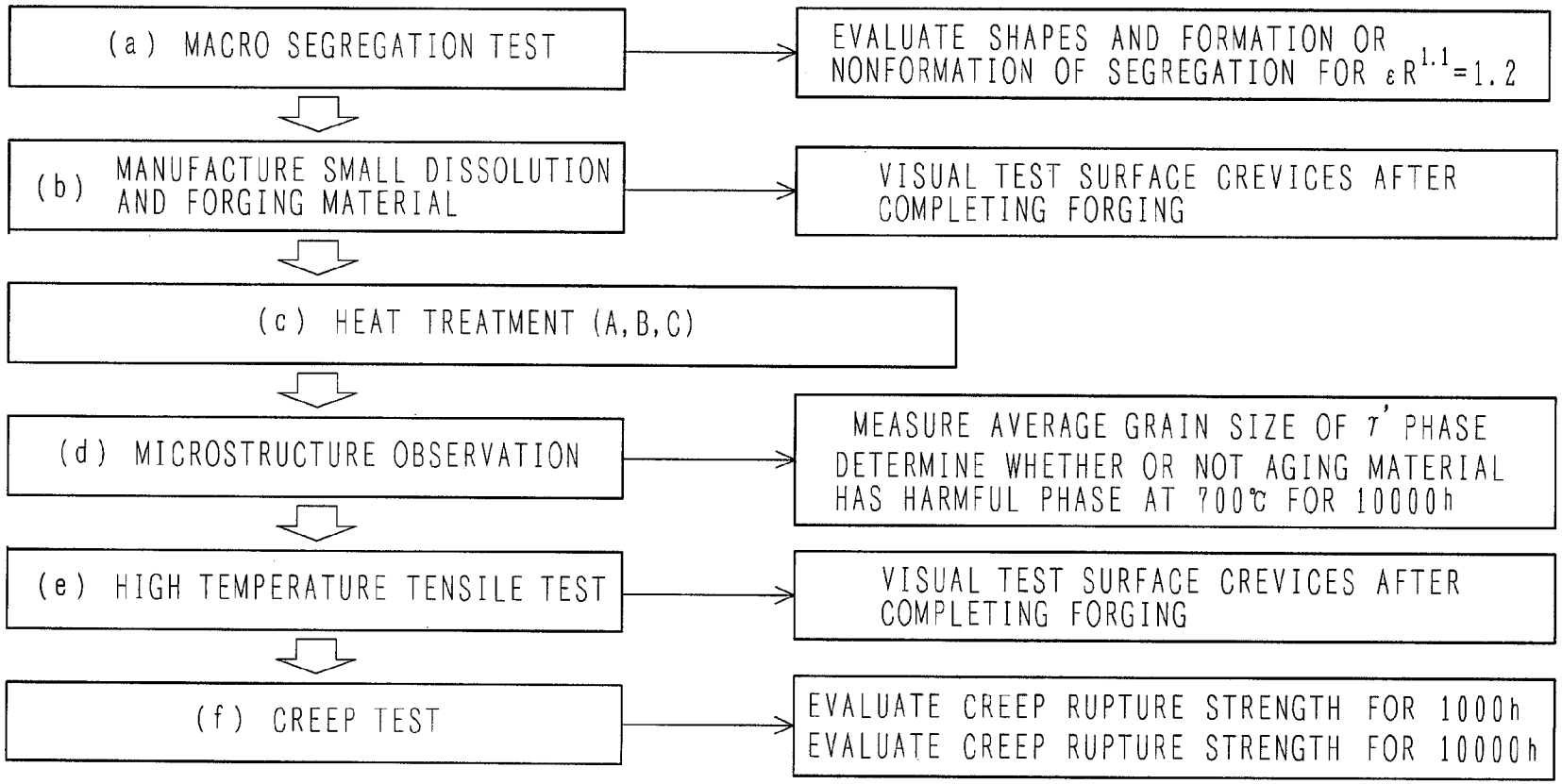
FIG. 1 is a diagram illustrating the test flows of the test materials used in the examples.

1: INVENTIVE MATERIAL
2: 12Cr STEEL

DETAILED DESCRIPTION OF THE PREFERRED EMBODIMENTS

The invention was accomplished by performing the decreasing of the amount of Nb and the addition of Al on the basis of the IN706 type or IN718 type alloy to enhance precipitation by a γ' phase, and forming an initial mean particle size of a γ' phase in the range of 50 to 100 nm to greatly improve high temperature ductility while keeping high temperature strength.

The Ni—Fe based forging superalloy in which an initial mean particle size of a γ' phase is in the range of 50 to 100 nm, can be manufactured, by way of example, by performing a solution-treatment, performing a first aging treatment in the range of 825 to 855° C., and then performing a second aging treatment in the range of 710 to 740° C. The temperature of the solution treatment is preferably in the range of 965 to 995° C. which is the standard temperature for such a type of an Ni based superalloy.

An initial mean particle size of a γ' phase can be controlled to 50 nm or more by performing the first aging treatment at a temperature of 825° C. or more for about 10 hours or less. If temperature of the first aging treatment exceeds 855° C., an initial mean particle size of the γ' phase may exceed 100 nm, thereby decreasing high temperature ductility. The second aging treatment is performed in order to increase the precipitated amount of the γ' phase, and the precipitated amount of the γ' phase can be increased by maintaining the forging materials at a lower temperature than that of the first aging treatment for a long time without coarsening the γ' phase. As used herein, the term "initial mean particle size" denotes a mean particle size after the completion of a heat treatment.

The reasons why the component range of an Ni—Fe based superalloy is defined will be described herein below.

If Fe is much added, the material cost is reduced since Fe is cheap. However, if Fe is excessively added into an alloy including Nb, a Laves phase is precipitated, thereby degrading the material property. Further, Fe has a tendency to promote floated segregation. Accordingly, if the additive amount of Fe is too much, floated segregation is likely to happen, and if the additive amount of Fe is too small, sedimented segregation is likely to happen. For the above-mentioned reasons, the additive amount of Fe is preferably in the range of 30 to 40 wt %.

Cr is beneficial in terms of corrosion resistance and oxidation resistance. However, if Cr is excessively added, an α phase or a δ phase which is a bad phase is precipitated. Hence, the additive amount of Cr is preferably in the range of 14 to 16 wt %.

Ti is an element stabilizing the γ' phase, and also contributing greatly to strength improvement. However, if Ti is excessively added, high temperature strength is greatly increased, thereby deteriorating hot workability. Furthermore, if Ti is added in excess, as an element which promotes floated macro segregation, floated segregation is promoted, and if the additive amount of Ti is too small, precipitated macro segregation is promoted. Moreover, if Ti is excessively added, the η phase which is the bad phase is precipiated. For these reasons, the additive amount of Ti is preferably in the range of 1.2 to 1.7 wt %.

Al is an element stabilizing the γ' phase and also contributing greatly to strength improvement. However, if Al is excessively added, high temperature strength is greatly increased, thereby deteriorating hot workability and also relatively destabilizing the η phase which is a bad phase. Further, if the additive amount of Al is too small, the η phase is precipated. For these reasons, the additive amount of Al is preferably in the range of 1.1 to 1.5 wt %.

Nb is an element stabilizing the γ' phase, and also contributing greatly to strength improvement. However, if Nb is excessively added, high temperature strength is greatly increased, thereby deteriorating hot workability and also promoting the precipitation of a harmful phase, such as a δ phase, an η phase, a Laves phase, etc., including a large amount of Nb. Furthermore, as an element which promotes floated macro segregation, if Nb is added in excess, sedimented macro segregation occurs, and if the additive amount of Nb is too small, macro segregation occurs. For these reasons, the additive amount of Nb is preferably in the range of 1.9 to 2.7 wt %.

C is bonded with Nb and Ti to form MC type carbide. MC carbide has an effect that makes the grain minute, since it suppresses the movement of the grain boundary by pinning effects. However, if the additive amount of C is too large, MC carbide is coarsely precipitated. As a result, the origin of breakdown is created and thus fatigue strength is decreased. Thus, the additive amount of C is preferably 0.05 wt % or less.

The Ni—Fe based superalloy of the invention includes the above-mentioned alloy components and the remainder is Ni. In addition to these components, elements incorporated during the course of manufacturing an ingot may be included as impurities. As used herein, such an impurity refers to as an inevitable impurity, since the incorporation of a little amount of impurity is unavoidable.

By employing the above-mentioned chemical components, the rotor material whose large steel ingot productivity, high temperature microstructual stabilities and high temperature strength are excellent can be provided. The component range in the invention is within the component range of an alloy described in JP-A-2005-2929 (Abstract). However, JP-A-2005-2929 (Abstract) does not disclose about heat treatment conditions and an initial mean particle size of a γ' phase. On the other hand, non-patent document 1 discloses 0.2% yield strength at 700° C. and an initial mean particle size of a γ' phase, with respect to a test material in which the alloy (FENIX-700), which is within the component range of an alloy described in the JP-A-2005-2929 (Abstract), was subject to solution treatment, and subsequently was subject to aging treatments at 732° C. and 621° C. According to the above document 1, the 0.2% yield strength is about 700 MPa and an initial mean particle size of the γ' phase is in the range of about 20 to about 30 nm. The aging treatments at 732° C. and 621° C. are standard conditions of the similar alloy IN706. A characteristic described in the non-patent document 1 is a similar property as a tensile strength characteristic described in the JP-A-2005-2929 (Abstract).

From this point of view, the component system of document 1 is not suitable for a rotor material, since high temperature strength is high but high temperature ductility is remarkably low, in the case that aging treatments are performed at 732° C. and 621° C.

A method of improving greatly high temperature ductility without sacrificing a necessary strength characteristic of the steam turbine rotors in these component systems will be described hereinafter.

Generally, strength and ductility are in a trade-off relation, and therefore it is difficult to improve ductility while keeping strength. The alloy having a component range according to the invention is an alloy in which the precipitation is enhanced by the γ' phase, and if the amount of Al, Nb, Ti, etc. is reduced and then the precipitated amount of the γ' phase is lowered, ductility is improved. However, high temperature strength is greatly decreased. In particular, since creep strength is greatly influenced by the precipitated amount of the γ' phase, the creep strength is greatly decreased in this method. In the steam turbine rotor, the required yield strength is low as compared with a gas turbine. Thus, as materials of the steam turbine rotor, the decrease of creep strength is fatal for materials of this component system, the materials being improved materials of the gas turbine disk material.

The strength of a γ' phase enhanced alloy is effected by an initial mean particle size of the γ' phase, in addition to the volume fraction of the γ' phase. If the volume fraction is constant, the strength is higher as an initial mean particle size is smaller. The present inventors found that high temperature ductility was greatly improved by changing heat treatment conditions within the component range of the invention to increase an initial mean particle size of the γ' phase. In addition, it was confirmed that a short-term creep strength is lowered as an initial mean particle size of the γ' phase is coarsened, but a long-term creep strength required for a steam turbine rotor is hardly effected by an initial mean particle size of the γ' phase. In addition, in this case, the decrease of the 0.2% yield strength was acceptable for the steam turbine rotor material.

In view of the above knowledge, the inventors found that a method of improving high temperature ductility without lowering the creep strength within the component range of the invention can be obtained by coarsening the γ' phase by using a heat treatment to have 50 to 100 nm in mean particle size. Additionally, in the component systems according to the invention, when an initial mean particle size of the γ' phase is in the range of 50 to 100 nm, a 0.2% yield strength of 450 to 600 MPa at 700° C. and a reduction of area of 25% or more was obtained. Accordingly, it is presumed that high temperature ductility is increased by such characteristic values.

Examples

Table 1 shows chemical compositions (weight %) of the test materials used in the Examples. For the test materials listed in table 1, the tests of (a) to (f) shown in FIG. 1 were done in order. The test results will be described herein below. Further, in the test, the subsequent test was not performed, for the test materials which already revealed results which are not compatible with steam turbine rotor materials.

TABLE 1

Chemical Compositions of Test Materials (weight %)

| | Heat treatment | Ni | Fe | Cr | Nb | Al | Ti | C |
|---|---|---|---|---|---|---|---|---|
| Alloy A | A | remnant | 36 | 15.5 | 2 | 1.3 | 1.6 | 0.03 |
| Alloy B | A | remnant | 36 | 15.5 | 1.5 | 1.3 | 1.6 | 0.03 |
| Alloy C | A | remnant | 36 | 15.5 | 2 | 0.7 | 1.6 | 0.03 |
| Alloy D | A | remnant | 36 | 15.5 | 2 | 1.2 | 2.2 | 0.03 |
| Alloy E | A | remnant | 36 | 15.5 | 2.5 | 2 | 1.8 | 0.03 |
| Alloy F | A | remnant | 36 | 15.5 | 3.2 | 1.3 | 1.7 | 0.03 |
| Alloy G | A | remnant | 25 | 15.5 | 2.6 | 1.3 | 1.7 | 0.03 |
| Alloy H | A | remnant | 50 | 15.5 | 2.5 | 1.3 | 2 | 0.03 |
| Alloy I | B | remnant | 36 | 15.5 | 2 | 1.3 | 1.6 | 0.03 |
| Inventive material A | C | remnant | 36 | 15.5 | 2 | 1.3 | 1.6 | 0.03 |
| Inventive material B | C | remnant | 30 | 15.5 | 2.2 | 1.3 | 1.6 | 0.03 |
| Inventive material C | C | remnant | 36 | 15.5 | 2 | 1.3 | 1.6 | 0.03 |
| Inventive material D | C | remnant | 32 | 15.5 | 2 | 1.3 | 1.6 | 0.004 |

A macro segregation test, same as in non-patent document 1, was performed by using a horizontally directional solidification furnace. According to the disclosure of non-patent document 1, in order to manufacturing an ingot of more than 850 mm ϕ by an electroslag remelting process (ESR process) without segregation, it is necessary not to produce segregation even though a value of $\epsilon R^{1.1}$ is lowered to 1.2 or less. Hence, in this test, it was determined whether or not segregation occurs by performing a texture observation in the peripheral area in which $\epsilon R^{1.1}$ was 1.2. Here, ϵ represents a cooling rate (° C./min.), and R represents a solidification rate (mm/min.).

Figure 2:
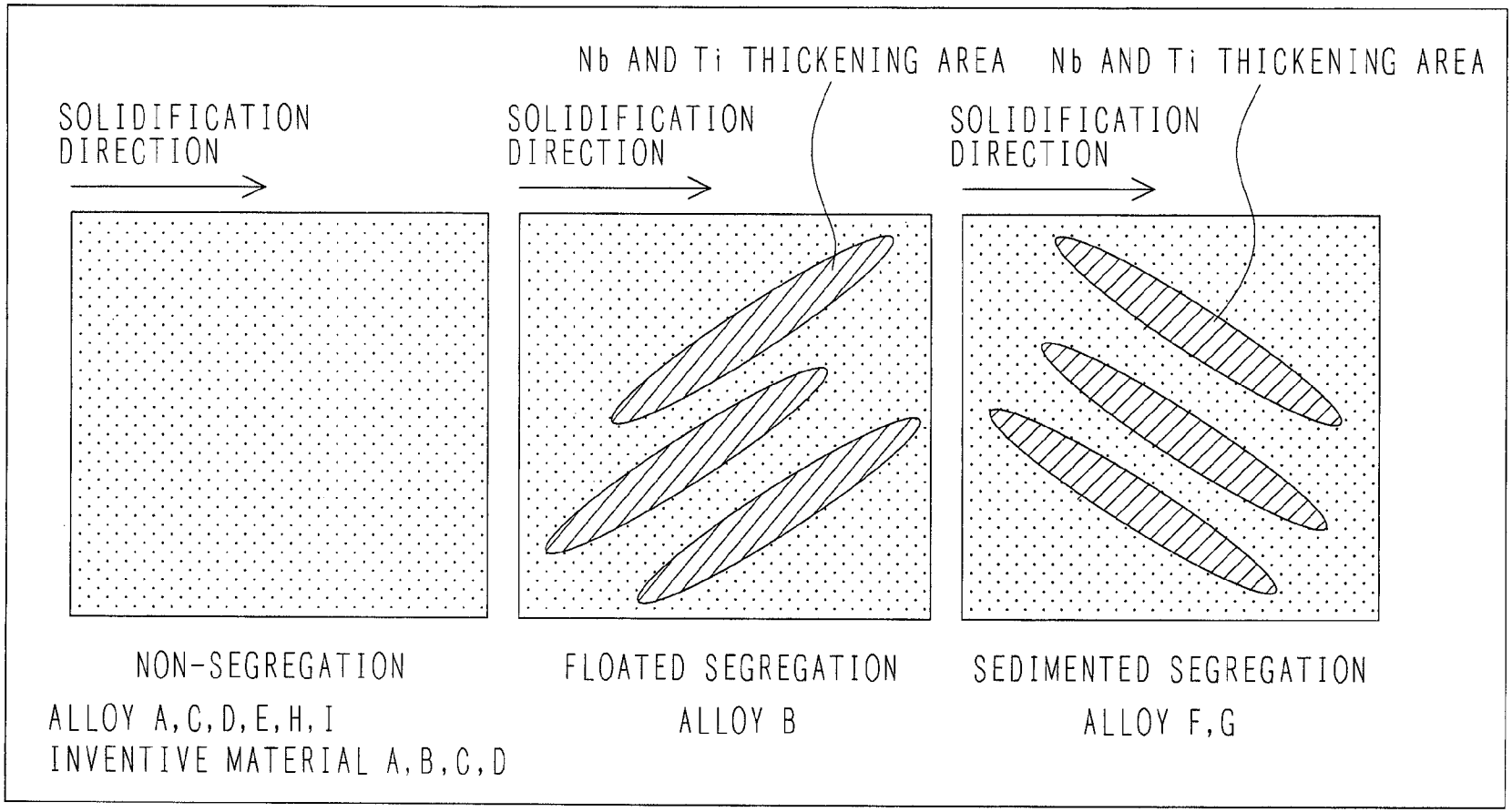
FIG. 2 is a diagram illustrating the macro segregation test results.

In FIG. 2, a schematic diagram of the macro texture observation result is illustrated. For alloys B, F and G, a macro segregation texture was observed. For alloy B, a thickening area of Nb and Ti was elongated upward relative to solidification directions, and floated macro segregations were observed. For alloys F and G, a thickening area of Nb and Ti was elongated downward relative to solidification directions, and sedimented macro segregations were observed. For other samples, textures specific to macro segregation were not observed. Accordingly, it can be seen from the above results that alloys B, F and G are unsuitable for manufacturing a steam turbine rotor.

Next, samples for texture evaluation and strength evaluation were manufactured with respect to the test materials except alloys B, F and G. In particular, 10 kg of an ingot was manufactured in a vacuum melting furnace, and then the ingot was subject to forging in the range of 1000 to 1200° C. to obtain about 30 nm of a square rod and then any one of heat treatments A to C shown in FIG. 3 was performed. In this case, for alloys E and H, a surface crack occurred. Alloy E was determined to be unsuitable for manufacture of the steam turbine rotor in terms of forgability. Further, in FIGS. 3, T1 and t1 denotes temperature and time of the solution treatment, and any one of T2, t2 and T3, t3 denotes temperature and time of the aging treatment.

Figure 3:
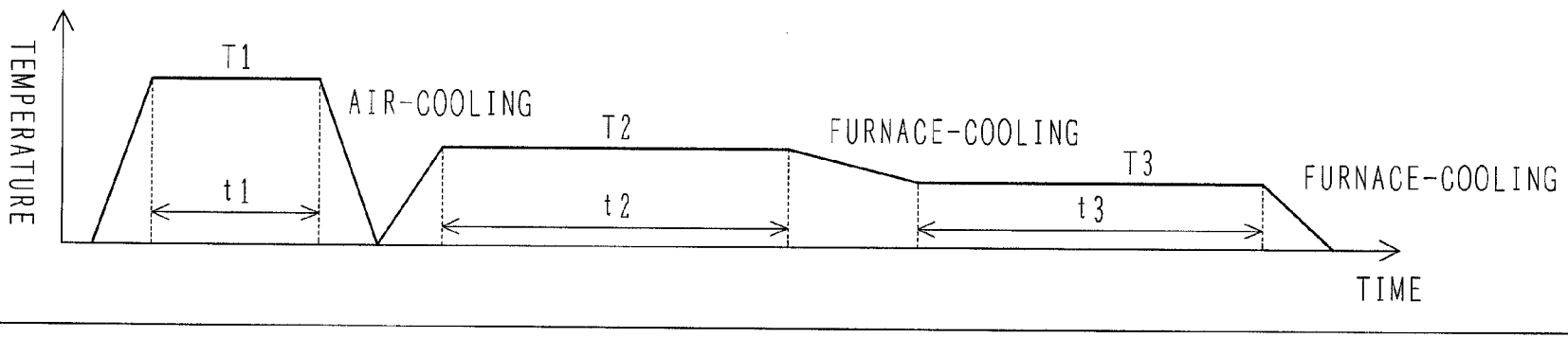
FIG. 3 is a diagram illustrating the methods and conditions of heat treatments.
Figure 4:
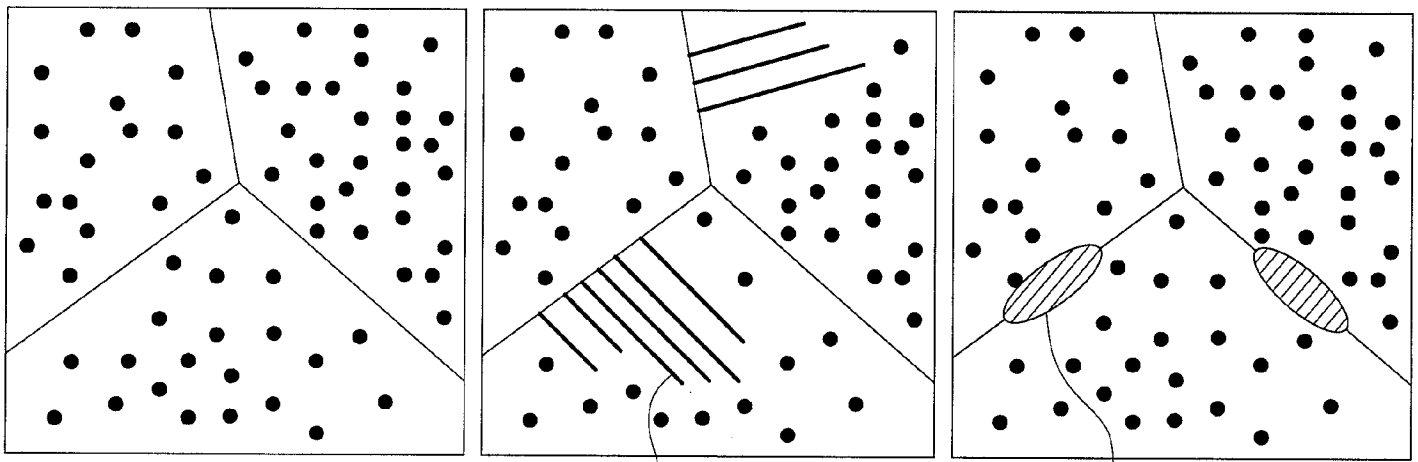
FIG. 4 is a diagram illustrating the microstructure analysis results of the aging treatment materials.

FIG. 4 illustrates the microstructure observation results for each sample. An initial mean particle size of the γ' phase was measured by performing the heat treatment shown in FIG. 3, performing SEM observations and then analyzing the SEM images. The aged microstructure schematic diagram shows microstructures, which was performed using the heat treatments shown in FIG. 3 and then performed aging treatments at 700° C. for 10000 h were performed. In this case, the reason why the aging treatment was performed at 700° C. for 10000 h is to understand the state of the turbine rotor when operated for a long time.

For alloys A, C, D, H and I, an initial mean particle size of the γ' phase in a state when the heat treatment shown in FIG. 3 was performed was 50 nm or less, and for inventive materials A, B, C and D was 50 nm or more. For alloys C and D after performing aging treatment at 700° C. for 10000 h, plate-like precipitations including much Ti and Nb were shown, and the γ' phase, which was a enhanced phase, disappeared in a area in which plate-like precipitations were precipitated. This was the η phase known as the harmful phase of an Ni based superalloy. For alloy H, the precipitations including much Nb and Fe were confirmed. The precipitations were determined to be a Laves phase which was the representative harmful phase of an Ni based superalloy. Further, it was determined from the above-mentioned results that alloys C, D and H were not compatible with the steam turbine rotor materials.

Figure 5:
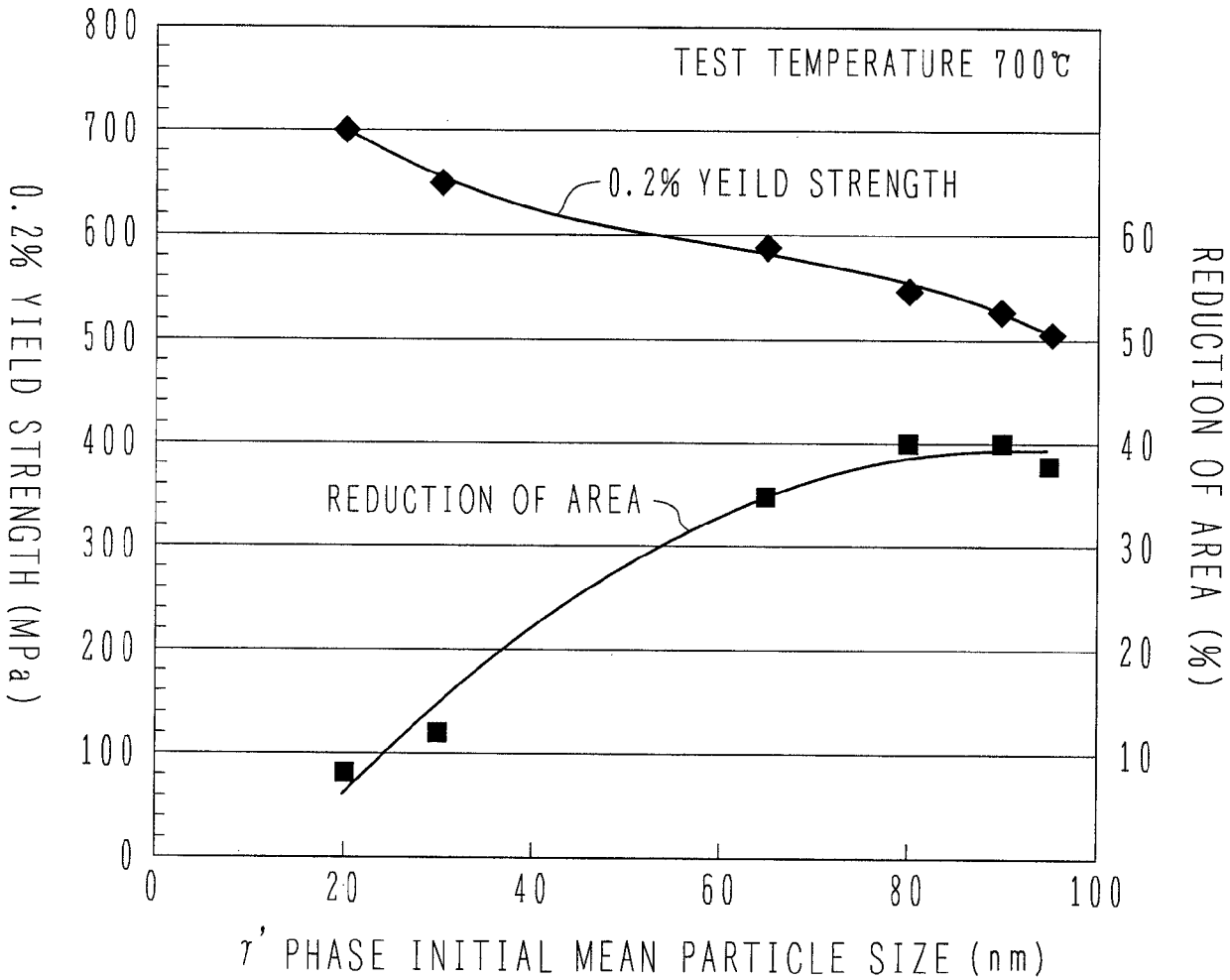
FIG. 5 is a diagram illustrating the tensile test results at 700° C.

FIG. 5 illustrates the results that a high temperature tensile test was performed at 700° C. for the alloys A and I, and inventive materials A, B, C and D which had no problems in the macro segregation, the forgability and the microstructure stability, and shows relations between an initial mean particle size of the γ' phase and the reduction of area, and the 0.2% yield strength.

When an initial mean particle size of the γ' phase is lower than 50 nm, since the 0.2% yield strength shows 600 MPa or more, the alloys have high strength, but have remarkably low reduction of area. On the contrary, the inventive materials having an initial mean particle size of γ' phase in the range of 50 to 100 nm, have a conspicuously improved reduction of area and have a strength required for the steam turbine rotor materials, even though they have 0.2% yield strength decreased.

Figure 6:
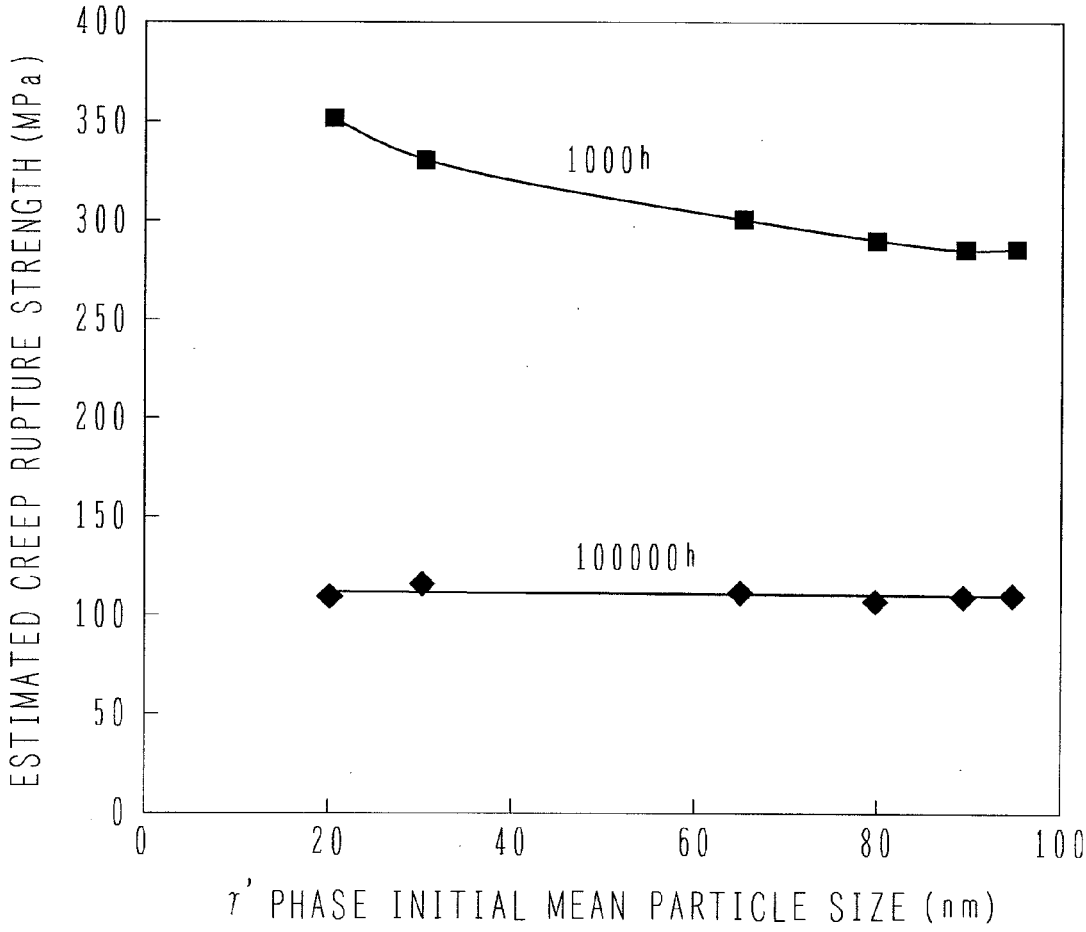
FIG. 6 is a diagram illustrating the creep rupture strength at 700° C.

FIG. 6 illustrates the results of creep tests at 700° C. The creep rupture strength for 1000 hours is increased as an initial mean particle size of the γ' phase is decreased, but the creep rupture strength for 100000 hours required for the steam turbine rotor materials is hardly effected by an initial mean particle size of the γ' phase. Accordingly, it is apparent that the inventive materials have more improved high temperature ductility compared to the alloys A and I, while the creep rupture strength is maintained equal to the alloys A and I.

Figure 7A:
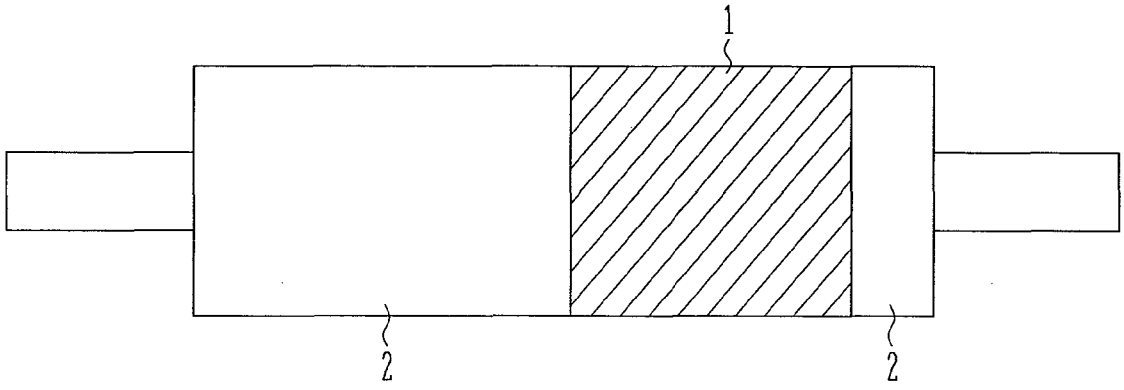
FIGS. 7A and 7B are schematic diagrams of the steam turbine rotor in which the inventive materials are used.
Figure 7B:
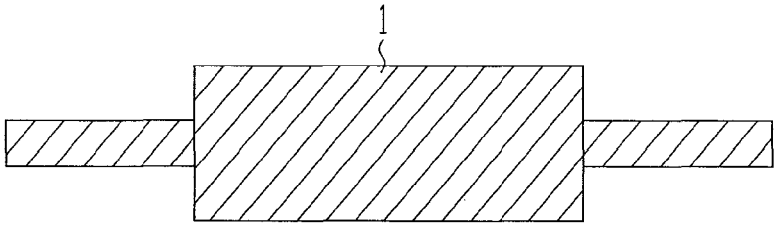

FIGS. 7A and 7B illustrate examples in which the inventive material was applied to a steam turbine rotor. In particular, FIG. 7A shows a case that a steam turbine rotor of about the 40 ton class was manufactured by bonding about 10 tons of the inventive material 1 with 12Cr steel 2 by using TIG welding. FIG. 7B shows a case that a steam turbine rotor of about the 10 ton class was integrally manufactured by using the inventive material 1.

A steam turbine power plant in which the main steam temperature exceeds 600° C. generally includes an ultrahigh-pressure turbine, a high-pressure turbine, and a middle- and a low-pressure turbine. In steam turbine power plants in which the main steam temperature is of the 700° C. class, the steam temperature at the entrance of the ultrahigh-pressure turbine is preferably 700° C. or more, and the pressure is preferably in the range of 25 to 35 MPa. Generally, the weight of the ultrahigh-pressure turbine is in the range of 8 to 20 tons. The Ni—Fe based superalloy according to the invention is available for an ultrahigh-pressure turbine rotor of these steam turbine power plants. Of course, the Ni—Fe based superalloy according to the invention is available for a turbine rotor of a steam turbine having a main steam temperature of 650° C.

The material according to the invention is equally applicable to any rotors of a high-pressure turbine, or a middle- or a low-pressure turbine. Rotors of these types having a weight of more than 40 tons are generally used. Accordingly, in such a case, as shown in FIG. 7A, it is desirable that these rotors are made as a welding structure along with 12Cr steel.

What is claimed is:

1. An Ni—Fe based forging superalloy comprising 30 to 40 wt % of Fe, 14 to 16 wt % of Cr, 1.2 to 1.7 wt % of Ti, 1.1 to 1.5 wt % of Al, 1.9 to 2.2 wt % of Nb, 0.05 wt % or less of C, and the remainder of Ni and inevitable impurities, wherein γ' phase ($Ni_3Al$) precipitate having an initial mean particle size of 50 to 100 nm is enhanced in the grain, wherein said Ni—Fe based superalloy forging material has a 0.2% yield strength of 450 to 600 MPa at 700° C. and reduction of area of 25% or greater, and wherein the C is bonded with Nb and Ti to form MC carbide.

2. A steam turbine rotor formed of an Ni—Fe based superalloy forging material comprising 30 to 40 wt % of Fe, 14 to 16 wt % of Cr, 1.2 to 1.7 wt % of Ti, 1.1 to 1.5 wt % of Al, 1.9 to 2.2 wt % of Nb, 0.05 wt % or less of C, and the remainder of Ni and inevitable impurities, wherein γ' phase ($Ni_3Al$) precipitate having an initial mean particle size of 50 to 100 nm is enhanced in the grain, wherein said Ni—Fe based superalloy forging material has a 0.2% yield strength of 450 to 600 MPa at 700° C. and reduction of area of 25% or greater, and wherein the C is bonded with Nb and Ti to form MC carbide.

3. The steam turbine rotor according to claim 2, wherein the rotor is an integral structure in which a welding portion is not included.

4. The steam turbine rotor according to claim 2, wherein the rotor is used for an ultrahigh-pressure turbine rotor of a steam turbine power plant having a main steam temperature of about 650° C. or about 700° C.

5. The steam turbine rotor according to claim 2, wherein the rotor is used for a large rotor having a weight of 10 ton to 20 ton.

6. A steam turbine rotor which is formed by a welding material of an Ni—Fe based superalloy forging material according to claim 2 bonded to 12 Cr steel by welding, and is used for a turbine rotor having a weight of more than 20 ton in a steam turbine power plant having a main steam temperature of about 650° C. or 700° C.

* * * * *